US006082111A

United States Patent [19]

Stokes

[11] Patent Number: 6,082,111

[45] Date of Patent: Jul. 4, 2000

[54] ANNULAR PREMIX SECTION FOR DRY LOW-$NO_X$ COMBUSTORS

[75] Inventor: Mitchell O. Stokes, Orlando, Fla.

[73] Assignee: Siemens Westinghouse Power Corporation, Orlando, Fla.

[21] Appl. No.: 09/096,218

[22] Filed: Jun. 11, 1998

[51] Int. Cl.[7] ..... F02C 1/00

[52] U.S. Cl. ..... 60/737; 60/746; 60/748

[58] Field of Search ..... 60/746, 747, 748, 60/737

[56] References Cited

U.S. PATENT DOCUMENTS

| | | | |
|---|---|---|---|
| 3,608,831 | 9/1971 | Place | 239/406 |
| 4,173,118 | 11/1979 | Kawaguchi | 60/39.65 |
| 4,193,260 | 3/1980 | Carlisle et al. | 60/737 |
| 4,271,675 | 6/1981 | Jones et al. | 60/737 |
| 4,373,342 | 2/1983 | Willis et al. | 60/748 |
| 5,253,478 | 10/1993 | Thibault, Jr. et al. | 60/733 |
| 5,359,847 | 11/1994 | Pillsbury | 60/39.06 |
| 5,896,739 | 4/1999 | Snyder et al. | 60/39.06 |
| 5,899,075 | 5/1999 | Dean et al. | 60/737 X |
| 6,026,645 | 2/2000 | Stokes et al. | 60/737 X |

OTHER PUBLICATIONS

U.S. application No. 08/759,395, Parker et al., filed Dec. 4, 1996.

*Primary Examiner*—Timothy S. Thorpe
*Assistant Examiner*—Ehud Gartenberg
*Attorney, Agent, or Firm*—Egkert Seamans Cherin & Mellott, LLC

[57] ABSTRACT

An annular premix section that reduces $NO_x$ and CO emissions of a gas turbine combustor by providing a more homogeneous fuel/air mixture for main stage combustion is provided. A gas turbine combustor according to the present invention includes a nozzle housing, a main fuel nozzle, and a main fuel swirler. A main combustion zone is located adjacent to the nozzle housing. The main fuel nozzle extends through the nozzle housing and is attached to a nozzle housing base. The tip of the main fuel nozzle is located downstream of the nozzle housing base. The main fuel swirler surrounds a portion of the main fuel nozzle, with a downstream end of the main fuel swirler located downstream of a main fuel injection port and upstream of the main fuel nozzle tip. The main fuel swirler is adapted to receive a flow of compressed air and to mix a fuel with the flow of compressed air to form a fuel/air mixture flow. An annular premix section, adjacent to the downstream end of the main fuel swirler, is adapted to receive and expand the fuel/air mixture flow. A contraction zone is located downstream of the premix section and upstream of the main combustion zone. The contraction zone is adapted to increase the velocity of the fuel/air mixture flow into the main combustion zone.

9 Claims, 4 Drawing Sheets

ANNULAR PREMIX SECTION FOR DRY LOW-$NO_X$ COMBUSTORS

FIELD OF THE INVENTION

The present invention relates to combustors for gas turbine engines. More specifically, the present invention relates to an annular premix section that reduces nitrogen oxide and carbon monoxide emissions produced by lean premix combustors.

BACKGROUND OF THE INVENTION

Gas turbines are known to comprise the following elements: a compressor for compressing air; a combustor for producing a hot gas by burning fuel in the presence of the compressed air produced by the compressor; and a turbine for expanding the hot gas produced by the combustor. Gas turbines are known to emit undesirable oxides of nitrogen ($NO_x$) and carbon monoxide (CO). One factor known to affect $NO_x$ emission is combustion temperature. The amount of $NO_x$ emitted is reduced as the combustion temperature is lowered. However, higher combustion temperatures are desirable to obtain higher efficiency and CO oxidation.

Two-stage combustion systems have been developed that provide efficient combustion and reduced $NO_x$ emissions. In a two-stage combustion system, diffusion combustion is performed at the first stage for obtaining ignition and flame stability. Premixed combustion is performed at the second stage to reduce $NO_x$ emissions.

The first stage, referred to hereinafter as the "pilot" stage, is normally a diffusion-type burner and is, therefore, a significant contributor of $NO_x$ emissions even though the percentage of fuel supplied to the pilot is comparatively quite small (often less than 10% of the total fuel supplied to the combustor). The pilot flame has thus been known to limit the amount of $NO_x$ reduction that could be achieved with this type of combustor. In a diffusion combustor, the fuel and air are mixed in the same chamber in which combustion occurs (i.e., a combustion chamber).

Pending U.S. patent application Ser. No. 08/759,395, assigned to the same assignee hereunder (the '395 application) and incorporated herein by reference, discloses a typical prior art gas turbine combustor. As shown in FIG. 1 herein, combustor 100 comprises a nozzle housing 6 having a nozzle housing base 5. A diffusion fuel pilot nozzle 1, having a pilot fuel injection port 4, extends through nozzle housing 6 and is attached to nozzle housing base 5. Main fuel nozzles 2, each having at least one main fuel injection port 3, extend substantially parallel to pilot nozzle 1 through nozzle housing 6 and are attached to nozzle housing base 5. Fuel inlets 16 provide fuel 102 to main fuel nozzles 2. A main combustion zone 9 is formed within a liner 19. A pilot cone 20, having a diverged end 22, projects from the vicinity of pilot fuel injection port 4 of pilot nozzle 1. A pilot flame zone 23 is formed within pilot cone 20 adjacent to main combustion zone 9.

Compressed air 101 from compressor 50 flows between support ribs 7 through main fuel swirlers 8. Each main fuel swirler 8 is substantially parallel to pilot nozzle 1 and adjacent to main combustion zone 9. Within each main fuel swirler 8, a plurality of swirler vanes 80 generate air turbulence upstream of main fuel injection ports 3 to mix compressed air 101 with fuel 102 to form a fuel/air mixture 103. Fuel/air mixture 103 is carried into main combustion zone 9 where it combusts. Compressed air 101 also enters pilot flame zone 23 through a set of stationary turning vanes 10 located inside pilot swirler 11. Compressed air 12 mixes with pilot fuel 30 within pilot cone 20 and combusts in pilot flame zone 23.

FIG. 2 shows a cross-sectional view of combustor 100 taken along line 2—2 of FIG. 1. As shown in FIG. 2, pilot nozzle 1 is surrounded by a plurality of main fuel nozzles 2. Pilot swirler 11 surrounds pilot nozzle 1. A main fuel swirler 8 surrounds each main fuel nozzle 2. Pilot swirler 11 forms an annulus 18 with liner 19. Fuel/air mixture 103 flows through main fuel swirlers 8 (out of the page) into main combustion zone 9 (not shown in FIG. 2). Compressed air 101 flows through annulus 18 (out of the page) in the space between main fuel swirlers 8.

Note that compressed air 101 in annulus 18 is not mixed with any fuel and does not flow into main combustion zone 9. Thus, an appreciable volume of compressed air within the main stage is wasted (i.e., not mixed with fuel before main stage combustion. Since, in a premix combustor, the fuel and air are mixed before combustion occurs, the greater the mass of the compressed air 101 that is mixed with fuel 102 in the main stage, the leaner the fuel/air mixture 103 (for a constant mass of fuel 102) that will flow into main combustion zone 9. It is known that leaner, more homogeneous fuel/air mixtures burn cooler and more evenly, thus decreasing $NO_x$ and CO emissions.

While gas turbine combustors such as the combustor disclosed in the '395 application have been developed to reduce $NO_x$ and CO emissions, current environmental concerns demand even greater reductions. Thus, there is a need in the art for a gas turbine combustor having a premix section that reduces $NO_x$ and CO emissions by providing leaner, more homogeneous fuel/air mixtures for main stage combustion.

SUMMARY OF THE INVENTION

The present invention satisfies these needs in the art by providing a premix section that reduces $NO_x$ and CO emissions of a gas turbine combustor by providing a more homogeneous fuel/air mixture for main stage combustion.

A gas turbine combustor according to the present invention comprises a nozzle housing having a nozzle housing base, a main fuel nozzle, and a main fuel swirler. A main combustion zone is located adjacent to the nozzle housing. The main fuel nozzle, having a main fuel injection port and a tip, extends through the nozzle housing and is attached to the nozzle housing base. The tip of the main fuel nozzle is located downstream of the nozzle housing base.

The main fuel swirler has an axis and a downstream end. The axis of the main fuel swirler is substantially parallel to the main fuel nozzle. The main fuel swirler surrounds a portion of the main fuel nozzle, with the downstream end of the main fuel swirler located downstream of the main fuel injection port and upstream of the main fuel nozzle tip. The main fuel swirler is adapted to receive a flow of compressed air and to mix a fuel with the flow of compressed air to form a fuel/air mixture flow.

A premix section, adjacent to the downstream end of the main fuel swirler, is adapted to receive and expand the fuel/air mixture flow. In a preferred embodiment, the premix section has a substantially annular cross-section. A contraction zone is located downstream of the premix section and upstream of the main combustion zone. The contraction zone is adapted to increase the velocity of the fuel/air mixture flow into the main combustion zone.

A gas turbine combustor according to the present invention further comprises a pilot nozzle, a pilot swirler, and a pilot cone. The pilot nozzle has a pilot fuel injection port and is disposed on an axial centerline of the gas turbine combustor, upstream of the main combustion zone. The pilot nozzle extends through the nozzle housing and is attached to the nozzle housing base. The pilot swirler has an axis that is substantially parallel to the pilot nozzle. The pilot swirler surrounds a portion of the pilot nozzle.

The pilot cone projects from the vicinity of the pilot fuel injection port of the pilot nozzle. The pilot cone has a diverged end adjacent to the main combustion zone. The tip of the main fuel nozzle is upstream of the diverged end of the pilot cone.

A gas turbine combustor according to the present invention further comprises a liner and a baseplate. The baseplate is disposed adjacent to the main combustion zone and has a plurality of airflow holes. The main fuel swirler is attached to the liner via the baseplate. The pilot cone and the liner form boundaries of the contraction zone.

DETAILED DESCRIPTION OF THE PREFERRED EMBODIMENT

Figure 3:
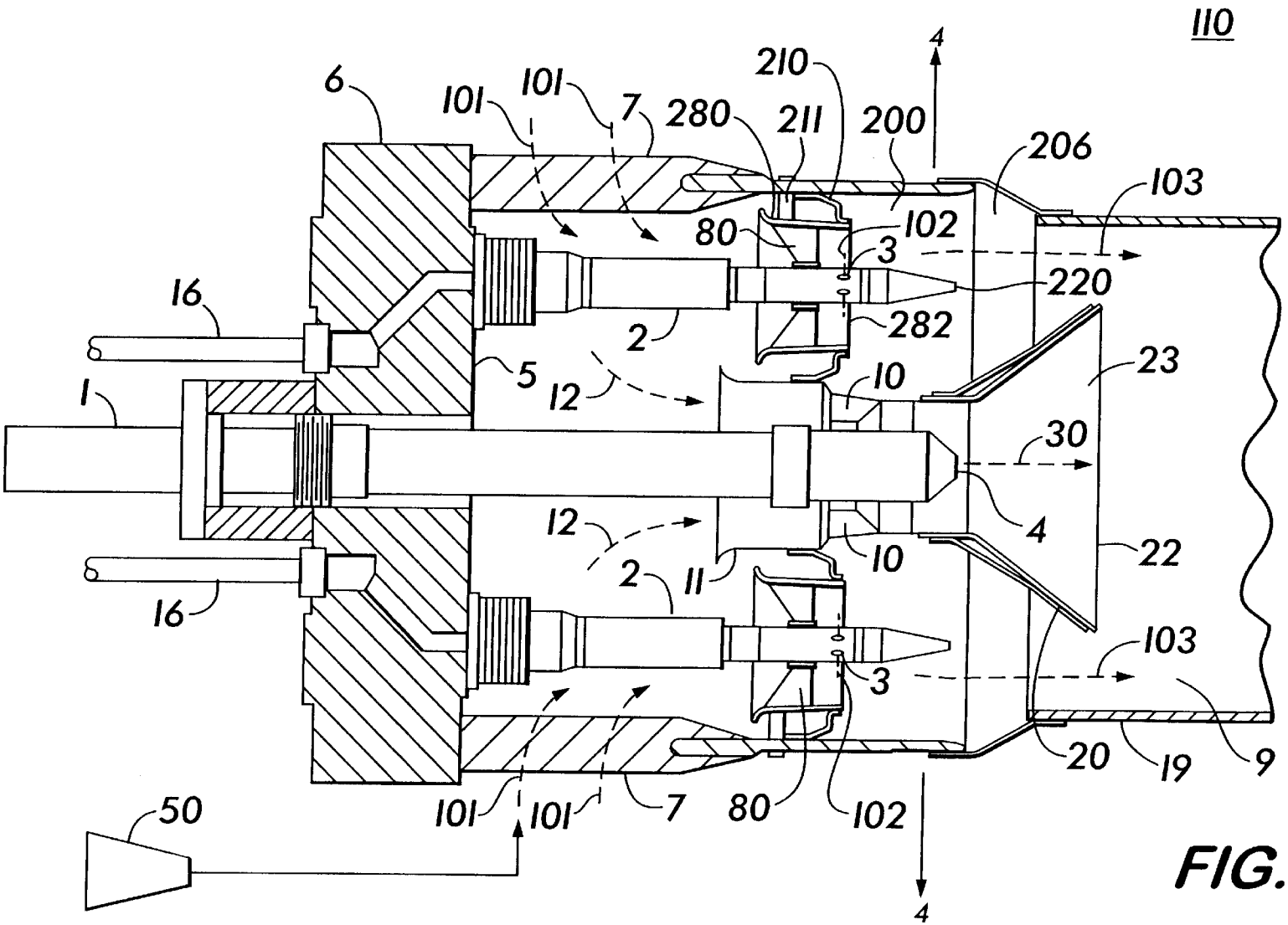
FIG. 3 shows an axial cross-sectional view of a preferred embodiment of a gas turbine combustor comprising an annular premix section according to the present invention.

FIG. 3 shows an axial cross-sectional view of a preferred embodiment of a gas turbine combustor 110 comprising an annular premix section 200 according to the present invention. As shown in FIG. 3, combustor 110 comprises a nozzle housing 6 having a nozzle housing base 5. A diffusion fuel pilot nozzle 1, having a pilot fuel injection port 4, extends through nozzle housing 6 and is attached to nozzle housing base 5. Main fuel nozzles 2, each having at least one main fuel injection port 3, extend substantially parallel to pilot nozzle 1 through nozzle housing 6 and are attached to nozzle housing base 5. Fuel inlets 16 provide fuel 102 to main fuel nozzles 2. A main combustion zone 9 is formed within a liner 19. A pilot cone 20, having a diverged end 22, projects from the vicinity of pilot fuel injection port 4 of pilot nozzle 1. A pilot flame zone 23 is formed within pilot cone 20 adjacent to main combustion zone 9.

Compressed air 101 from compressor 50 flows between support ribs 7 and enters pilot flame zone 23 through a set of stationary turning vanes 10 located inside pilot swirler 11. Compressed air 12 mixes with pilot fuel 30 within pilot cone 20 and is carried into pilot flame zone 23 where it combusts. Compressed air 101 flows into each of a plurality of main fuel swirlers 280. Each main fuel swirler 280 is substantially parallel to pilot nozzle 1 and is located upstream of main combustion zone 9. Within each main fuel swirler 280, a plurality of swirler vanes 80 generate air turbulence upstream of main fuel injection ports 3 to mix compressed air 101 with fuel 102 to form a fuel/air mixture 103. Fuel/air mixture 103 is carried through annular premix section 200, through a contraction zone 206, and then into main combustion zone 9 where it combusts.

Main fuel swirler 280 has a downstream end 282. According to the present invention, downstream end 282 of main fuel swirler 280 is downstream of main fuel injection port 3 and upstream of the tip 220 of main fuel nozzle 2. Preferably, downstream end 282 of main fuel swirler 280 is as close as possible to main fuel injection port 3, thus providing the longest possible annular premix section 200. Main fuel swirler 280 is attached to liner 19 and pilot swirler 11 via baseplate 210 and brackets 211.

Figure 1:
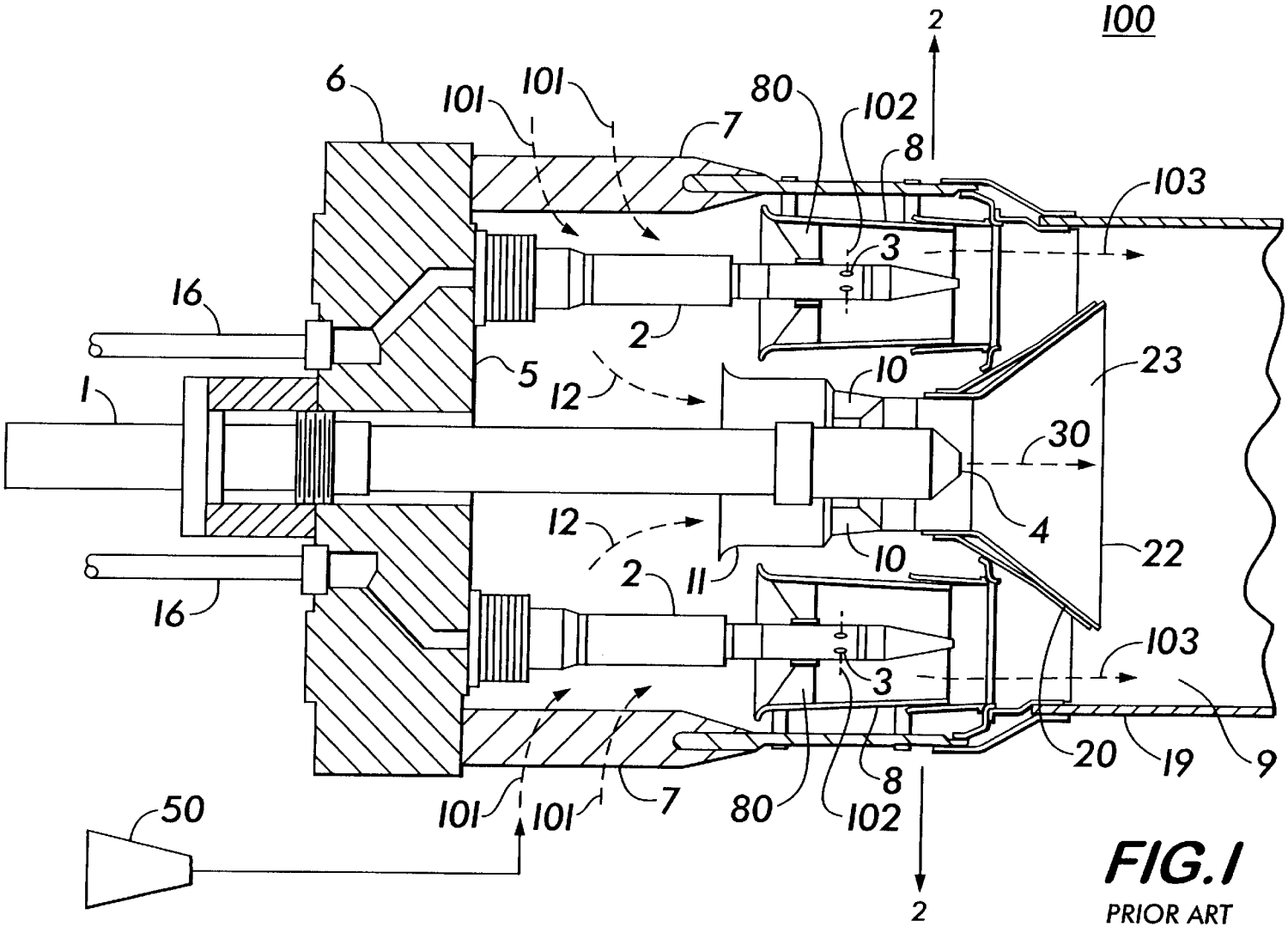
FIG. 1 PRIOR ART
FIG. 1 shows an axial cross-sectional view of a prior art gas turbine combustor.
Figure 2:
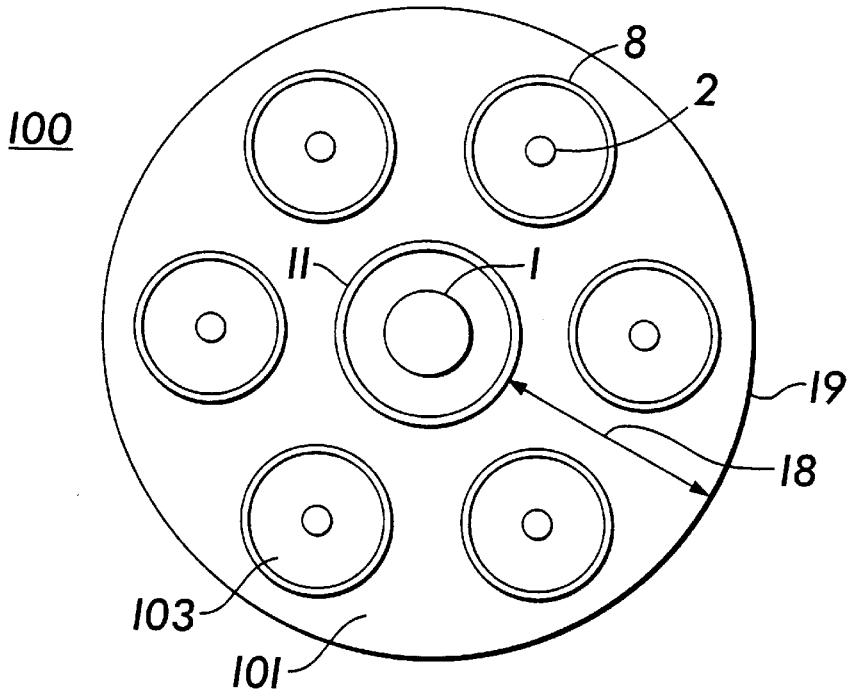
FIG.2 PRIOR ART
FIG. 2 shows a cross-sectional view of the prior art gas turbine combustor of FIG. 1 taken along line 2—2 thereof.
Figure 4:
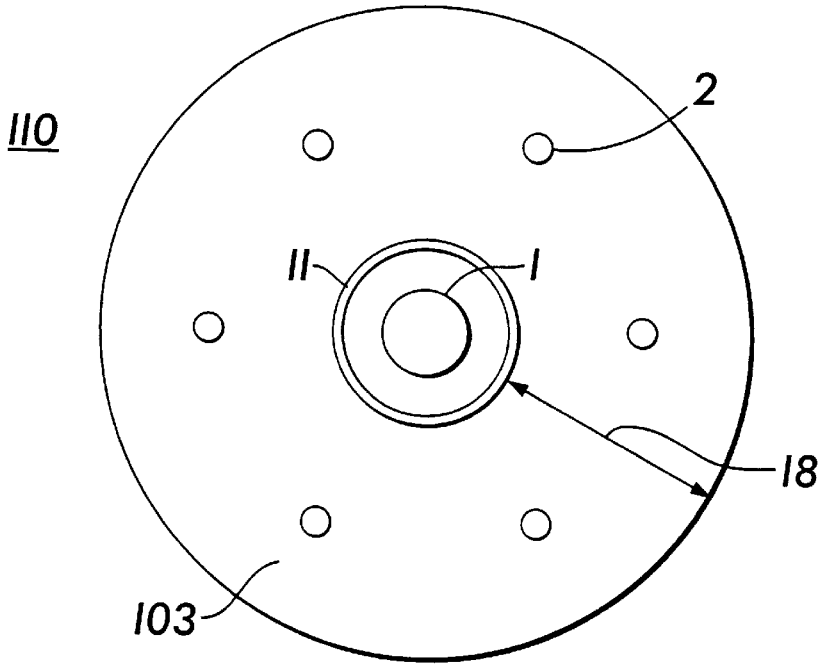
FIG. 4 shows a cross-sectional view of the gas turbine combustor of FIG. 3 taken along line 4—4 thereof.

FIG. 4 shows a radial cross-sectional view of combustor 110. As shown in FIG. 4, pilot nozzle 1 is surrounded by a plurality of main fuel nozzles 2. Pilot swirler 11 surrounds pilot nozzle 1. However, in contrast to prior art combustion turbine 100, main fuel nozzles 2 are not surrounded by main fuel swirlers within annular premix section 200. Pilot swirler 11 forms an annulus 18 with liner 19. According to the present invention, fuel/air mixture 103 flows through annulus 18 (out of the page) into contraction zone 206 and then into main combustion zone 9 (not shown in FIG. 4). Note that, in contrast to prior art combustion turbine 100, all the compressed air in annulus 18 is now premixed with fuel. Thus, by comparison to prior art gas turbine combustor, a greater volume of air is mixed with the same mass of fuel, creating a leaner, more homogeneous fuel/air mixture 103. As explained above, a leaner, more homogeneous fuel/air mixture 103 will bum cooler and more evenly, resulting in a desirable decrease in $NO_x$ and CO emissions.

Figure 5:
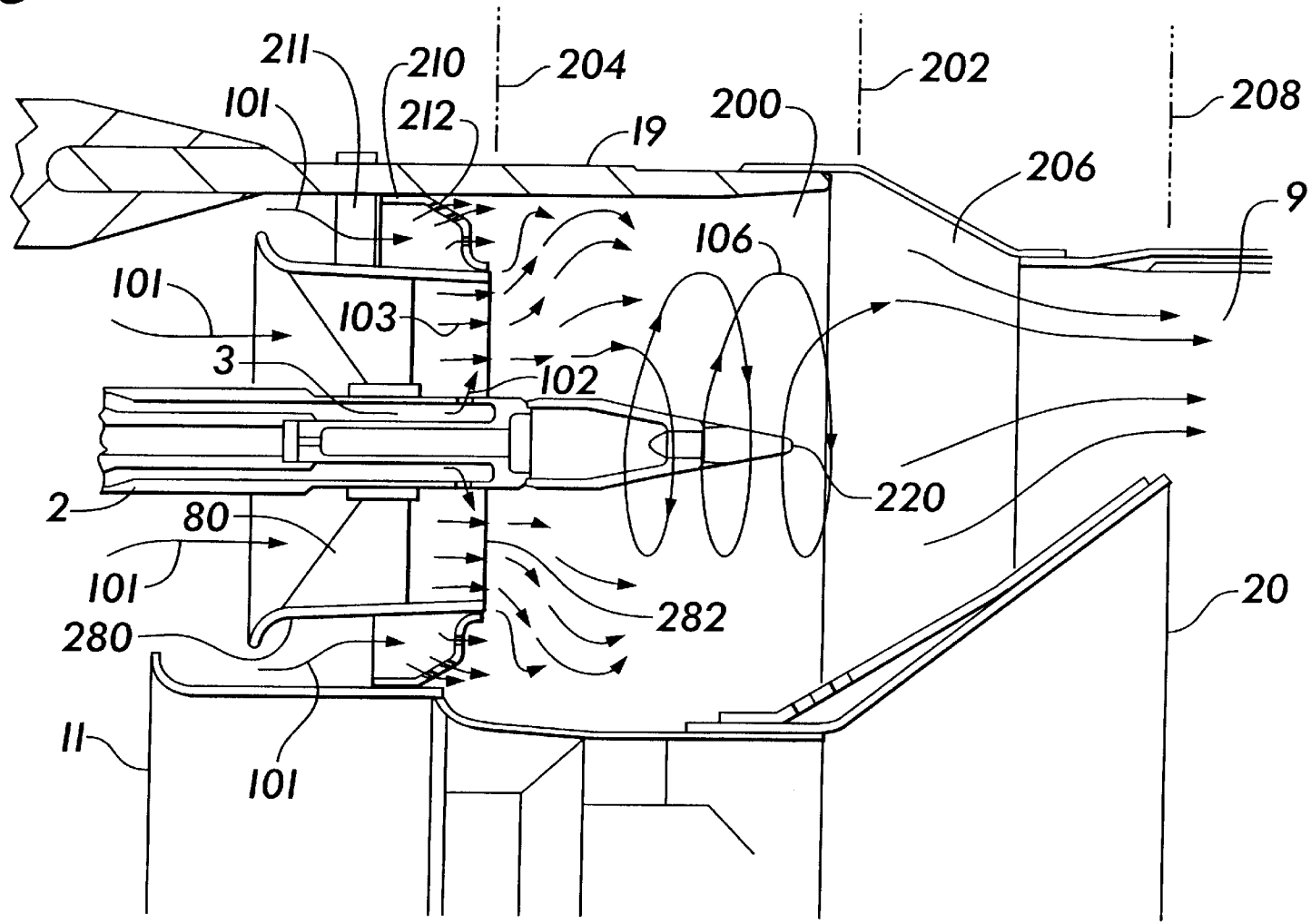
FIG. 5 shows a detailed axial cross-sectional view of an annular premix section according to the present invention.

FIG. 5 shows a detailed axial cross-sectional view of an annular premix section 200 according to the present invention. As shown in FIG. 5, compressed air 101 enters main fuel swirler 280 and passes over vanes 80. Vanes 80 are located upstream of fuel injection ports 3 of main fuel nozzle 2 and create turbulence in the flow of compressed air 102 within main fuel swirler 280. Compressed air 101 mixes with fuel 102 to form fuel/air mixture 103. Fuel/air mixture 103 is then carried into annular premix section 200.

In the embodiment shown in FIG. 5, a plane of sudden expansion 204 exists coincident with downstream edge 282 of main fuel swirler 280. Plane of sudden expansion 204 is formed, in essence, by baseplate 210. Brackets 211 attach main fuel swirler 280 to liner 19 and pilot swirler 11. As fuel/air mixture 103 exits main fuel swirler 280, fuel/air mixture 103 expands into annular premix section 200. This sudden expansion causes a more homogeneous fuel/air mixture 103.

Moreover, baseplate 210 has airflow holes 212 that allow compressed air 101 to enter directly into annular premix section 200 without passing through main fuel swirler 280. Thus, fuel/air mixture is not trapped between baseplate 210 and liner 19. Without airflow holes 212 in base plate 210, a "dead zone" would exist just downstream of baseplate 210. This dead zone is a region within main combustion zone 9 in which there is very little flow velocity. The flow of compressed air 101 through airflow holes 212 prevents the flame from being held in the dead zone. Moreover, airflow holes 212 allow more compressed air 101 into main combustion zone 9 causing fuel/air mixture 103 to become even leaner.

As shown in FIG. 5, downstream end 282 of main fuel swirler 280 is upstream of tip 220 of main fuel nozzle 2. Swirler vanes 80 create a vortex 106 around main fuel nozzle 2 to further homogenize fuel/air mixture 103. Thus, fuel/air mixture 103 of the present invention is both leaner and more homogenous than fuel/air mixture 103 of the prior art combustor 100. Consequently, combustor 110 emits less $NO_x$ and CO than prior art combustor 100.

It is important to note that combustor 110 also provides additional protection against the possibility of flashback.

Flashback occurs when the flame in main combustion zone 9 backs up into annular premix section 200. In a preferred embodiment of the present invention, a contraction zone 206 is located downstream of main fuel nozzle tip 220. Contraction zone 206 is formed by the radially outward divergence of pilot cone 20 and the radially inward convergence of liner 19. The divergence of pilot cone 20 and the convergence of liner 19 begin in a plane of beginning of contraction 202. Fuel/air mixture 103 continues through contraction zone 206 until it enters main combustion zone 9. As contraction zone 206 narrows, the velocity of fuel/air mixture 103 increases. The velocity of the flow is greatest in the plane of flashback barrier 208. Flashback barrier 208 is coincident with the diverged end of pilot cone 20 since, thereafter, fuel/air mixture 103 once again expands into main combustion zone and its velocity is reduced. The increased velocity of the flow reduces the possibility that the flame in main combustion zone 9 can be carried upstream into annular premix section 200. Thus, the gas turbine combustor 110 of the present invention not only decreases the emission of pollutants, but also the possibility of flashback as well.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

What is claimed is:

1. A gas turbine combustor, comprising: a nozzle housing, said nozzle housing having a nozzle housing base, a main combustion zone located adjacent to said nozzle housing; a main fuel nozzle, said main fuel nozzle having a main fuel injection port and a tip, said main fuel nozzle extending through said nozzle housing and attached to the nozzle housing base, the tip of said main fuel nozzle located downstream of the nozzle housing base; and a main fuel swirler, said main fuel swirler having an axis, swirler vanes, and a downstream end, the axis of said main fuel swirler substantially parallel to said main fuel nozzle, said main fuel swirler surrounding a portion of said main fuel nozzle, the downstream end of said main fuel swirler located downstream of said main fuel injection port and upstream of said main fuel nozzle tip; and the main fuel injection port located downstream of the swirler vanes.

2. The gas turbine combustor of claim 1, further comprising:

a pilot nozzle having a pilot fuel injection port, said pilot nozzle disposed on an axial centerline of said gas turbine combustor upstream of the main combustion zone, said pilot nozzle extending through said nozzle housing and attached to the nozzle housing base; and a pilot swirler having an axis, the axis of said pilot swirler substantially parallel to said pilot nozzle, said pilot swirler surrounding a portion of said pilot nozzle.

3. The gas turbine combustor of claim 2, further comprising:

a pilot cone having a diverged end, said pilot cone projecting from the vicinity of the pilot fuel injection port of said pilot nozzle, the diverged end of said pilot cone adjacent to the main combustion zone, the tip of said main fuel nozzle upstream of the diverged end of said pilot cone.

4. The gas turbine combustor of claim 1, said gas turbine combustor further comprising a liner and a baseplate, said baseplate having a plurality of airflow holes; and wherein said main fuel swirler is attached to said liner via said baseplate, said baseplate disposed adjacent to said main combustion zone.

5. A gas turbine combustor comprising: a nozzle housing, said nozzle housing having a nozzle housing base, a main combustion zone located adjacent to said nozzle housing; a main fuel nozzle, said main fuel nozzle having a main fuel injection port and a tip, said main fuel nozzle extending through said nozzle housing and attached to the nozzle housing base, the tip of said main fuel nozzle located downstream of the nozzle housing base; and a main fuel swirler having swirler vanes and a downstream end, said main fuel swirler surrounding a portion of said main fuel nozzle, the downstream end of said main fuel swirler located downstream of the main fuel injection port of said main fuel nozzle and upstream of the tip of said main fuel nozzle, the main fuel injection port located downstream of the swirler vanes, said main fuel swirler adapted to receive a flow of compressed air, said main fuel swirler adapted to mix a fuel with the flow of compressed air to form a fuel/air mixture flow; and a premix section adjacent to the downstream end of said main fuel swirler, said premix section adapted to receive and expand said fuel/air mixture flow.

6. The gas turbine combustor of claim 5, wherein said premix section has a substantially annular cross-section.

7. The gas turbine combustor of claim 5, wherein said fuel/air mixture flow has a velocity, said gas turbine combustor further comprising:

a contraction zone, said contraction zone located downstream of said premix section and upstream of said main combustion zone, said contraction zone adapted to increase the velocity of said fuel/air mixture flow.

8. The gas turbine combustor of claim 7, said gas turbine combustor further comprising:

a pilot nozzle having a pilot fuel injection port, said pilot nozzle disposed on an axial centerline of said gas turbine combustor upstream of the main combustion zone, said pilot nozzle extending through said nozzle housing and attached to the nozzle housing base;

a pilot swirler having an axis, the axis of said pilot swirler substantially parallel to said pilot nozzle, said pilot swirler surrounding a portion of said pilot nozzle; and a pilot cone projecting from the vicinity of the pilot fuel injection port of said pilot nozzle, said pilot cone having a diverged end adjacent to the main combustion zone.

9. The gas turbine combustor of claim 8, wherein said gas turbine combustor further comprises a liner; and wherein said pilot cone and said liner form boundaries of said contraction zone.

* * * * *